United States Patent [19]

Sayles

[11] Patent Number: 4,812,180

[45] Date of Patent: Mar. 14, 1989

[54] HIGH INTENSITY YELLOW SMOKE AND FLAME FLARE COMPOSITIONS

[75] Inventor: David C. Sayles, Huntsville, Ala.

[73] Assignee: The United States of America as represented by the Secretary of the Army, Washington, D.C.

[21] Appl. No.: 245,237

[22] Filed: Sep. 9, 1988

[51] Int. Cl.[4] ..... C06B 45/10

[52] U.S. Cl. ..... 149/19.5; 149/19.6; 149/19.9; 149/81; 149/116; 149/117

[58] Field of Search ..... 149/19.5, 19.6, 19.9, 149/81, 116, 117

[56] References Cited

U.S. PATENT DOCUMENTS

| | | | |
|---|---|---|---|
| 2,995,526 | 8/1961 | DeMent | 149/81 |
| 3,046,168 | 2/1962 | Burkardt et al. | 149/117 |
| 3,668,026 | 6/1972 | Flanagan | 149/19.5 |
| 3,723,206 | 3/1973 | Dinsdale et al. | 149/19.5 |
| 3,769,107 | 10/1973 | Johnson et al. | 149/19.6 |
| 3,802,971 | 4/1974 | Burkardt et al. | 149/19.9 |
| 3,954,529 | 5/1976 | Reed et al. | 149/19.6 |
| 4,184,901 | 1/1980 | Tanner et al. | 149/19.6 |

*Primary Examiner*—Edward A. Miller

*Attorney, Agent, or Firm*—Freddie M. Bush; James T, Deaton

[57] ABSTRACT

High intensity yellow smoke and flame flare compositions are manufactured by a procedure which closely parallels that of solid rocket propellants. These compositions use similar ingredients to those used in solid rocket propellants. These compositions are castable whereas conventional flares consist of pressed flare charges. Both colored flame and smoke are produced from the same composition. A liquid curable binder composition is selected from triethylene glycol succinate or carboxyl-terminated polybutadiene crosslinked with O,NN-tris(2,3-epoxypropyl)-4-aminophenol, and hydroxyl-terminated polybutadiene crosslinked with isophorone diisocyanate. The color producing ingredient is a first inorganic salt of lead iodide which can be further enhanced by an additive of a reactive source of iodine selected from iodine pentoxide and iodoform. A second inorganic salt is selected from inorganic oxidizing salts consisting of potassium perchlorate and amononium perchlorate. An optional additive of a magnesium metal is used where a good flame of yellow color is required. A large yellow-colored cloud produced from specific compositions is due to the condensation of the inorganic oxides and halides which produce submicron combustion particulates which do not undergo settling, or sedimentation. Their high specific surface area functions to enhance the color and to increase the size of the flare cloud.

5 Claims, No Drawings

HIGH INTENSITY YELLOW SMOKE AND FLAME FLARE COMPOSITIONS

DEDICATORY CLAUSE

The invention described herein may be manufactured, used, and licensed by or for the Government for governmental purposes without the payment to me of any royalties thereon.

BACKGROUND OF THE INVENTION

Present day flare compositions do not produce both smoke and flame because of a design feature that is necessary to prevent the organic dyes of the conventional pressed colored flare compositions from being destroyed by the intense heat of a flame. This design feature which results in an increase in the persistency of the smoke includes a deflagration without much flame to achieve sublimation of the organic dyes which are then subsequently oxidized in the combustion process.

To obtain both a luminous flame and colored smoke from conventional flares it is necessary to have two separate compositions. These are ignited at different ends depending upon whether smoke or luminosity is wanted.

A flare composition for use in signal or marking devices which is capable of producing colored smoke clouds of much higher intensity and persistency are highly desirable. These are not presently obtainable from such conventional devices.

Therefore, an object of this invention is to provide smoke and flame flare compositions which produce colored smoke and flame for illumination from the same composition.

Another object of this invention is to provide smoke and flame flare compositions which are manufactured by a procedure which closely parallels that of rocket propellants.

A further object of this invention is to provide smoke and flame flare compositions which employ ingredients similar to those used in solid rocket propellants.

Still a further object of this invention is to provide smoke and flame flare compositons which are castable.

SUMMARY OF THE INVENTION

Castable flare compositions that are manufactured by a procedure which closely parallels that of solid rocket propellants and which employ ingredients similar to those used in solid rocket propellants produce yellow colored flame and smoke from the same composition.

The yellow smoke/flame composition is obtained by the use of inorganic salts selected from lead iodide, potassium perchlorate, and ammonium perchlorate, an optional magnesium metal additive, an optional reaction source of iodine selected from iodine pentoxide and iodoform to intensify the color and a liquid curable binder.

The castable flare compositions employ a liquid curable binder wherein the prepolymer and curative is selected from carboxyl-terminated polybutadiene crosslinked with O,N,N-tris(2,3-epoxypropyl)-4-aminophenol, hydroxylterminated polybutadiene prepolymer crosslinked with isophorone diisocyanate, and triethylene glycol succinate crosslinked with O,N,N-tris(2,3-epoxypropyl)-4-aminophenol.

A yellow smoke/flame composition is comprised of lead iodide, potassium perchlorate, and a liquid curable binder. A yellow smoke/flame composition is comprised of lead iodide, ammonium perchlorate, and magnesium metal. A yellow smoke (with no flame) composition is comprised of lead oxide and ammonium perchlorate.

DESCRIPTION OF THE PREFERRED EMBODIMENT

High intensity yellow smoke and flame flare compositions are set forth in the Table below which discloses the composition and color characteristics of flame and smoke.

TABLE

Composition and Color Characteristics of Yellow Flares

| Ingredients/ characteristics | Flare Compositions I | II | III | IV |
|---|---|---|---|---|
| Prepolymer | | | | |
| Polyester | 15 | 0 | 15 | 15 |
| Carboxyl-terminated Polybutadiene | 0 | 15 | 0 | 0 |
| Inorganic Salts | | | | |
| Lead Iodide | 63 | 60 | 65 | 65 |
| Potassium Perchlorate | 20 | 25 | 0 | 0 |
| Ammonium Perchlorate | 0 | 0 | 20 | 19 |
| Magnesium Metal | 2 | 0 | 0 | 1 |
| Flame Characteristics | | | | |
| Flame Color | yellow | little flame | no flame | yellow |
| Smoke Color | light yellow | yellow | light yellow | light yellow |
| Smoke Density | Very Good | Very Good | Very Good | Good |

The propolymer represented in the Table by the polyester and carboxyl-terminated polybutadiene serves as a representative of the curable binder which is selected for the flare composition. Carboxyl-terminated polybutadiene and triethylene glycol succinate are each crosslinked with O,N,N-tis(2,3-epoxpropyl)-4-aminophenol or similar crosslinking agent used in obtaining the condensation of carboxylic acids with polyhydric alcohols. Hydroxylterminated polybutadiene prepolymer crosslinked with isophorone diisocyanate can also be selected for the curable binder for the flare composition.

The Table test data indicates that from 1 to 2 parts of magnesium ensures production of flame. The source of yellow color is produced by lead iodide; however, when a reactive source of iodine, such as, iodine pentoxide or iodoform is used in the manufacture of the flare, the color is more intense. The incorporation of lead or its oxides in combination with other iodine sources produces intense yellow smokes of comparable intensity of those obtained with lead iodide formulations.

The oxygen content of the binder strongly influences the intensity of the shade of color. The direct substitution of polymers which have a higher carbon content, such as, the carboxyl-terminated polybutadiene instead of the triethylene glycol succinate will produce a darker yellow flare.

HIGH INTENSITY YELLOW SMOKE AND FLAME FLARE COMPOSITIONS

The teachings of this invention encompass a method of producing yellow day-night marker compositions. This uniqueness of this disclosure is due to the fact that these marker compositions produce both a smoke and a flame for use in a signal or marking device which will function in both daylight and in darkness.

In contrast, conventional flare have one or the other of these characteristics. Previously, it was not possible to produce a persistent colored smoke because the organic dye which was used to produce the colored smoke was destroyed even if the flame temperature was relatively cool (1000° C). Present flares operate at temperatures of the order of 2500° C.

The approach used in this invention involves metals and metal derivatives as the means of imparting the yellow color. This approach also contributes to the increase in effectiveness of enhancing the intensity of the color. The increased effectiveness is due to the condensation of the inorganic oxides and halides which produce submicron combustion particulates. These submicron particles do not undergo settling, or sedimentation, but form a cloud. Their high specific surface area functions to enhance the color, and results in increasing the size of the flare cloud.

The most vivid clouds are produced by metallic iodides. Several highly effective yellow smoke/flame compositions are shown in the Table. These compositions comprised lead iodide, potassium or ammonium perchlorate and magnesium, in combination with a polymerizable prepolymer which are generally used in the fabrication of rocket propellants.

The prepolymers and curatives, including the structural formulae of the curative or crosslinking agent for each prepolymer, are set forth hereinbelow.

The prepolymer, triethylene glycl succinate (Witco F 17-80), whose structure is also shown below, is crosslinked with O,N,N-tris(2,3-epoxypropyl)-4-aminophenol or with similar crosslinking agent used in obtaining the condensation of carboxylic acids with polyhydric alcohols or derivatives thereof.

*

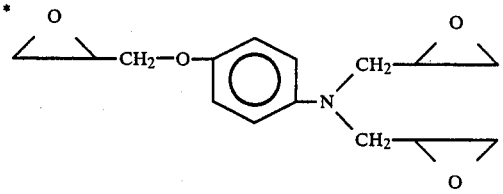

O,N,N—tris(2,3-epoxypropyl)-4-aminophenol*

**

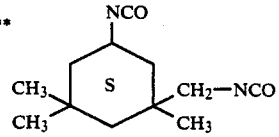

isophorone diisocyanate**

* Crosslinking agent for:

(1) Carboxyl-terminated polybutadiene prepolymer, and

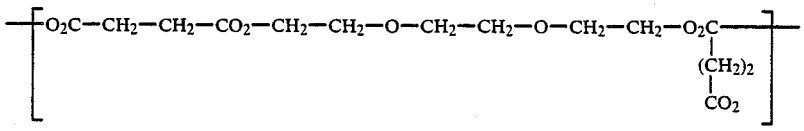

(2) Triethylene glycol sucinate (Witco F 17-80).

** Crosslinking agent for hydroxyl-terminated polybutadiene prepolymer.

I claim:

1. A high intensity yellow smoke and flame composition comprising:

(i) a liquid, curable binder composition in an amount of about 15 weight percent wherein the prepolymer and curative of said liquid, curable binder composition is selected from the group consisting of a carboxyl-terminated polybutadiene prepolymer crosslinked with
O,N,N-tri(2,3-epoxypropyl)-4-aminophenol, triethylene glycol succinate prepolymer crosslinked with
O,N,N-tris(2,3-epoxypropyl)-4-aminophenol, and a hydroxylterminated polybutadiene prepolymer crosslinked with isophorone diisocyanate;

(ii) a first inorganic salt of lead iodide in an amount from about 60 weight percent to about 65 weight percent;

(iii) a second inorganic salt selected from the inorganic oxidizing salts consisting of potassium perchlorate in an amount from 0 to 25 weight percent and ammonium perchlorate in an amount from 0 to 20 weight percent, said second inorganic oxidizing salt being present as a single salt with the requirement that when one of said second inorganic oxidizing salt in weight percent is present the other of said inorganic oxidizing salt is 0 weight percent;

(iv) an optional magnesium metal in an amount from 0 to about 2 weight percent; and, (v) an optional additive of a reactive source of iodine selected from iodine pentoxide and iodoform, said optional additive of a reactive source of iodine being employed to produce more intense yellow smoke as compared with a high intensity yellow smoke and flame composition containing only said first inorganic salt of lead iodide as the sole source of iodine.

2. The high intensity yellow smoke and flame composition of claim 1 wherein said liquid, curable binder composition position prepolymer and curative is said triethylene glycol succinate prepolymer crosslinked with O,N,N-tris(2,3-epoxypropyl)-4-aminophenol is present in an amount of about 15 weight percent; said first inorganic salt of lead iodide is present in an amount of about 63 weight percent; said second inorganic salt of oxidizing salt is potassium perchlorate in an amount of about 20 weight percent; and wherein said magnesium metal is present in an amount of about 2 weight percent.

3. The high intensity yellow smoke and flame composition of claim 1, wherein said liquid, curable binder composition prepolymer and curative is said carboxyl-terminated polybutadiene prepolymer crosslinked with O,N,N-tris(2,3-epoxypropyl)-4-aminophenol is present in an amount of about 15 weight percent; said first inorganic salt of lead iodide is present in an amount of about 60 weight percent; and wherein said second inorganic salt of oxidizing salt is potassium perchlorate which is present in an amount of about 25 weight percent.

4. The high intensity yellow smoke and flame composition of claim 1, wherein said liquid, curable binder copposition prepolymer and curative is said triethylene glycol succinate prepolymer crosslinked with O,N,N-tris(2,3-epoxypropyl)-4-aminophenol is present in an amount of about 15 weight percent; said first inorganic salt of lead iodide is present in an amount of about 65 weight percent; and wherein said second inorganic salt of oxidizing salt is ammonium perchlorate which is present in an amount of about 20 weight percent.

5. The high intensity yellow smoke and flame composition of claim 1 wherein said liquid, curable binder composition prepolymer and curative is said triethylene glycol succinate prepolymer crosslinked with O,N,N-tris(2,3-epoxypropyl)-4-aminophenol is present in an amount of about 15 weight percent; said first inorganic salt of lead iodide is present in an amount of about 65 weight percent; said second inorganic salt of oxidizing salt is ammonium perchlorate which is present in an amount of about 19 weight percent; and wherein said magnesium metal is present in an amount of about 1 weight percent.

* * * * *